US007621728B2

(12) United States Patent
Miller

(10) Patent No.: US 7,621,728 B2
(45) Date of Patent: Nov. 24, 2009

(54) PUMP INLET MANIFOLD

(76) Inventor: J. Davis Miller, 6 Horizon Point, Frisco, TX (US) 75034-6840

( * ) Notice: Subject to any disclaimer, the term of this patent is extended or adjusted under 35 U.S.C. 154(b) by 497 days.

(21) Appl. No.: 11/146,695

(22) Filed: Jun. 7, 2005

(65) Prior Publication Data

US 2005/0276708 A1 Dec. 15, 2005

Related U.S. Application Data

(60) Provisional application No. 60/578,687, filed on Jun. 10, 2004.

(51) Int. Cl.
*F04B 39/10* (2006.01)
*F04B 53/10* (2006.01)

(52) U.S. Cl. ..... 417/568; 417/539; 417/540; 417/571; 417/454

(58) Field of Classification Search ..... 417/565, 417/273, 900, 567, 569, 571, 568, 454, 539, 417/540; 291/41; 137/561 A, 561 R; 122/511; 521/50; 285/55; 138/26, 30
See application file for complete search history.

(56) References Cited

U.S. PATENT DOCUMENTS 2,366,814 A * 1/1945 Smith ..... 285/110
3,146,724 A * 9/1964 Cornelsen ..... 417/539
4,032,265 A 6/1977 Miller
4,129,324 A * 12/1978 Jones, Jr. ..... 285/107
4,445,829 A 5/1984 Miller
4,456,440 A * 6/1984 Korner ..... 417/540
4,512,368 A * 4/1985 Kaminaka et al. ..... 137/561 A
4,585,400 A 4/1986 Miller
4,712,578 A * 12/1987 White ..... 137/271
5,311,904 A * 5/1994 Beppu ..... 137/561 R
5,334,352 A * 8/1994 Johnson ..... 422/99
5,474,102 A * 12/1995 Lopez ..... 137/271
5,575,262 A * 11/1996 Rohde ..... 123/467
5,765,814 A * 6/1998 Dvorak et al. ..... 251/127
5,960,827 A * 10/1999 Rosenberg ..... 137/561 A
6,418,909 B2 * 7/2002 Rossi et al. ..... 123/456
2002/0108660 A1 * 8/2002 Braun et al. ..... 138/30

* cited by examiner

*Primary Examiner*—Devon C Kramer
*Assistant Examiner*—Peter J Bertheaud
(74) *Attorney, Agent, or Firm*—Gardere Wynne Sewell LLP

(57) ABSTRACT

A reciprocating piston/plunger pump inlet manifold includes an elongated cylindrical manifold member closable at opposite ends by transverse end caps connected to the manifold member by releasable couplings. A rubber or polymer liner formed with nitrogen filled closed cells is disposed within the manifold member. Spaced apart fluid discharge guide and mixing tubes are connected to the manifold member and include flanges for securing the manifold to inlet valve housings of a pump. The fluid flow guide and mixing tubes include partitions and a mixing chamber portion of the tubes. Improved fluid flow characteristics with minimal solids separation and minimal fluid velocity or acceleration induced pressure losses are exhibited by the manifold.

17 Claims, 3 Drawing Sheets

PUMP INLET MANIFOLD

CROSS REFERENCE TO RELATED APPLICATION

This application claims the benefit of U.S. Provisional Patent Application Ser. No. 60/578,687 filed Jun. 10, 2004.

BACKGROUND OF THE INVENTION

Many applications for reciprocating piston/plunger pumps require pumping fluids with entrained solids particulates. For example, pumps for use in pumping well drilling fluids, slurries of mined ore particulates and slurries of mine tailings require pumping fluids with substantial quantities of solids particulates which should not be allowed to accumulate in the pump manifolding or to be unevenly distributed to the pump cylinders thereby causing excessive wear on or damage to certain pump components.

Heretofore one pump component that has suffered from accumulations of solids particulates and the uneven distribution of solids particulates in the fluid throughput comprises the pump inlet manifold. In multi-cylinder reciprocating plunger pumps, typically, a pump inlet manifold is connected to a source of fluid with entrained solids particulates and distributes the fluid to the respective pump cylinders. However, uneven distribution of solids particulates often occurs through the manifold discharge ports and there is a tendency for particulates to drop out of the fluid flowstream and accumulate near one or more of the manifold discharge passages resulting in uneven wear on pump components, such as valving, cylinders and plungers, and possibly clogging one or more cylinders at their respective inlet passages. In addition, uneven solids distribution and uneven fluid flow produces erratic pump operation which may cause damage, including fatigue failure of valves, crank and wrist pin bearings, connecting rods and crankshafts, for example.

There has also been a continuing need to develop multicylinder pumping equipment which provides more even fluid inlet flow to the individual pump cylinders, minimizes pressure fluctuations, minimizes so-called fluid acceleration pressure losses associated with sudden fluid velocity changes and prevents fluid from reaching peak flow velocity in the pump inlet piping. The present invention overcomes several disadvantages experienced with prior art pumping systems, including but not limited to those mentioned hereinabove.

SUMMARY OF THE INVENTION

The present invention provides an improved fluid inlet manifold for reciprocating piston/plunger type pumps.

In accordance with one aspect of the present invention an improved pump inlet manifold is provided which includes a relatively large volume tank or manifold member disposed close to the pump cylinder inlet ports so as to respond to pump chamber fluid accelerations when the pump inlet valves open. The inlet manifold is provided with a liner of resilient material, such as foamed rubber, which includes closed cell nitrogen filled chambers operable to provide manifold volume capacity change as pressures change within the manifold. The resilient closed cell liner is operable to maintain a "gas charge" within the chambers formed by the foamed rubber or polymer liner thereby, essentially, requiring no maintenance. The dynamic response characteristics of the closed cell nitrogen filled foamed rubber or polymer liner provides response to pressure changes from full vacuum to relatively high fluid inlet pressures. Thus, essentially no mechanical limit is imposed on the nitrogen charged liner as compared with conventional fluid inlet stabilizer devices.

In accordance with further aspects of the present invention an improved pump inlet manifold is provided wherein fluid velocities are stabilized in the pump inlet piping thereby minimizing pressure drops by preventing the fluid flow from reaching peak pump velocity in the inlet piping. Velocity stabilization in the inlet piping reduces acceleration pressure losses associated with sudden fluid velocity changes in the inlet piping when pump valves open. Acceleration induced pressure variations from pump inlet valve opening and closing is prevented from entering the pump inlet piping. The manifold of the invention also provides one or more guide tubes operable to minimize fluid pressure losses, take advantage of forces which concentrate any entrained solids centrally in the pumped fluid flow stream and provides linear flow into the pump inlet valves.

Still further, the improved inlet manifold of the invention includes pump inlet valve port mixing tubes adapted to provide uniform solids distribution to the pump inlet valves. The fluid guide and mixing tubes are provided in a single conduit, respectively, extending within the manifold and having inlet opening portions disposed in a position to provide for substantially full entrainment of solids that tend to otherwise separate due to centrifugal forces or settle to the bottom side of the manifold.

Still further, the aforementioned cellular type liner disposed within the manifold provides a solids fluidization mechanism that prevents collecting of solids in the manifold chamber that can restrict fluid flow into the pump chambers. Moreover, the cellular type liner provides rheological mechanisms that reduce the viscosity in the pump inlet manifold of shear thinning fluids to minimize pressure drop throughout the pump inlet ports and inlet valves.

Those skilled in the art will further appreciate the above-mentioned advantages and superior features of the invention upon reading the detailed description which follows in conjunction with the drawings.

DETAILED DESCRIPTION OF A PREFERRED EMBODIMENT

Figure 1:
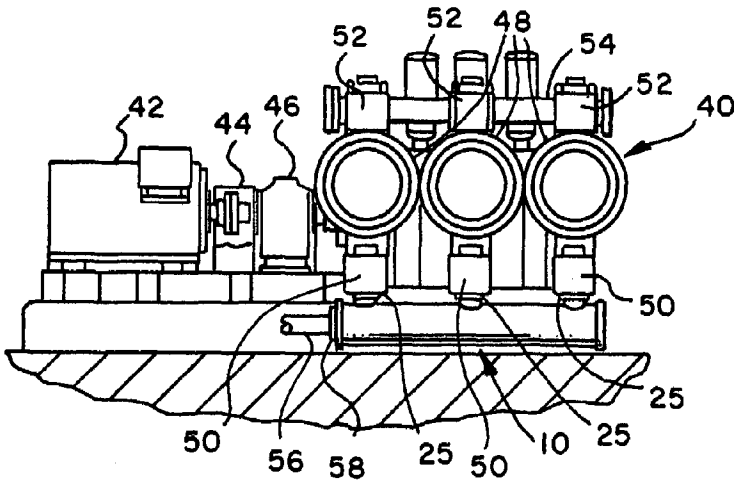
FIG. 1 is an end view of a multicylinder plunger pump including a pump inlet manifold in accordance with the invention.

In the description which follows, like parts are marked throughout the specification and drawing with the same reference numbers, respectively. The drawing figures may not be to scale and certain features may be shown in somewhat schematic form or exaggerated in scale in the interest of clarity and conciseness.

Referring to FIG. 1, there is illustrated a conventional multicylinder reciprocating plunger pump 40 adapted to be driven by a motor 42 in a conventional manner through a coupling 44 and a speed reduction drive mechanism 46, for example. Pump 40 includes, by way of example, three cylinders 48 forming a so-called triplex plunger pump. Cylinders 48 are each provided with inlet valve housings 50 suitably connected to the cylinders as well as discharge valve housings 52 also suitably connected to the cylinders 48. Discharge valve housings 52 are suitably connected to a fluid discharge manifold 54. As shown in FIG. 1, pump 40 is provided with a fluid inlet manifold 10 in accordance with the invention. Fluid being pumped by the pump 40 is delivered to the inlet manifold 10 by way of a conduit 56 suitably connected to a flange 58 which, in turn, is connected to an inlet flange or end cap 14 of manifold 10, see FIG. 2 also. The illustration of FIG. 1, as well as the exemplary embodiment of the manifold 10, is for a triplex plunger pump. However, the present invention may be utilized in pump designs of various configurations, particularly pumps having two, three, four or as many as nine, generally side by side cylinders forming a so-called fluid end of the pump.

Figure 2:
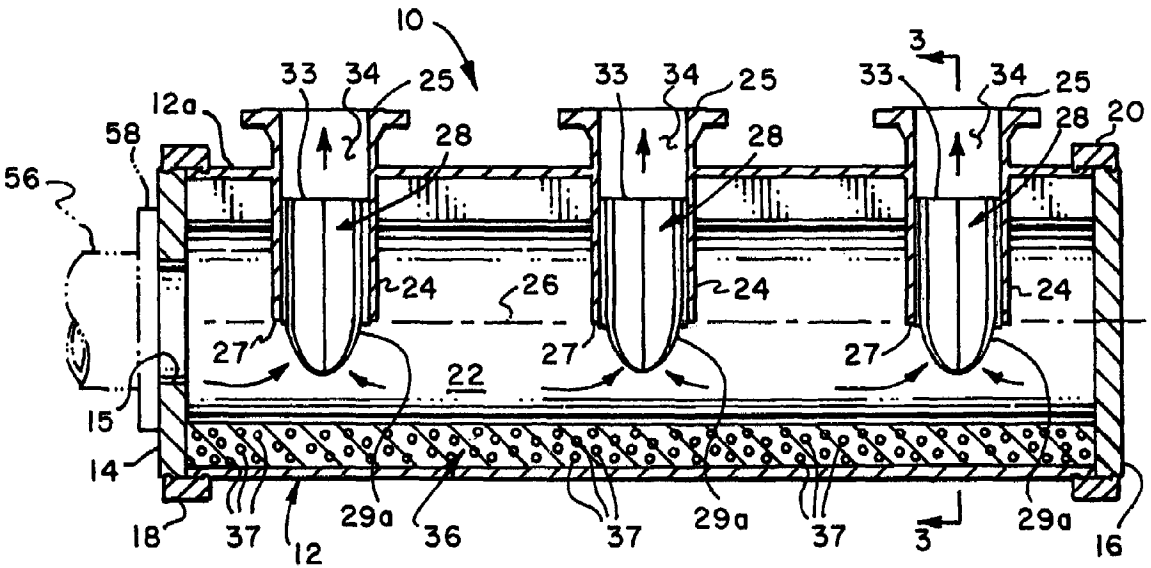
FIG. 2 is a longitudinal central section view of the inlet manifold shown in FIG. 1.

Referring to FIG. 2, the manifold 10 is characterized by a generally cylindrical elongated manifold member 12 and opposed transverse end cap or flange members 14 and 16 which may be releasably secured to the member 12 by suitable couplings 18 and 20, respectively. The couplings 18 and 20 may be a type commercially available, such as one of a type available from VICTAULIC COMPANY OF AIVIERICA, Easton, Pa. The end cap 14 is adapted to be connected to flange 58 of conduit 56 and is provided with a port 15 for admitting fluid into an elongated manifold chamber 22, FIG. 1. Fluid may be admitted to a manifold in accordance with the invention at one or both ends of the manifold or through a suitable fitting connected directly to member 12. Other configurations of end cap members, such as conventional bolted flanges, may be used in place of the members 14, 16, 18 and 20.

Figure 3:
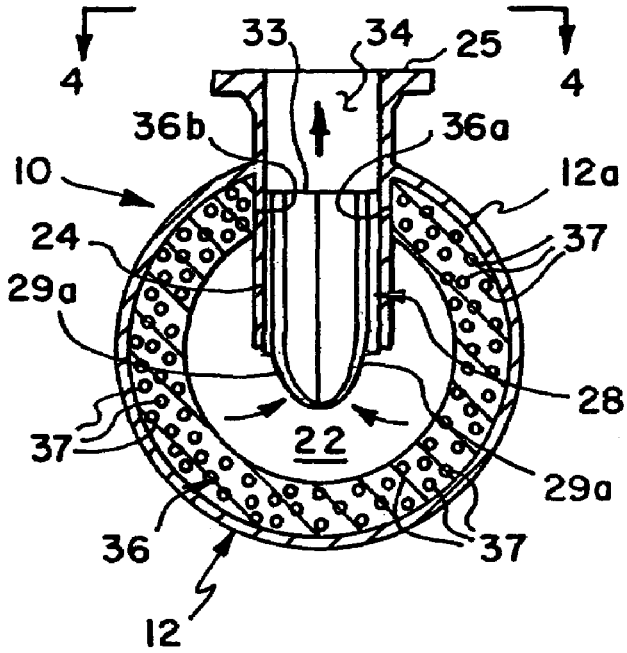
FIG. 3 is a section view taken generally along the line 3-3 of FIG. 2.
Figure 5:
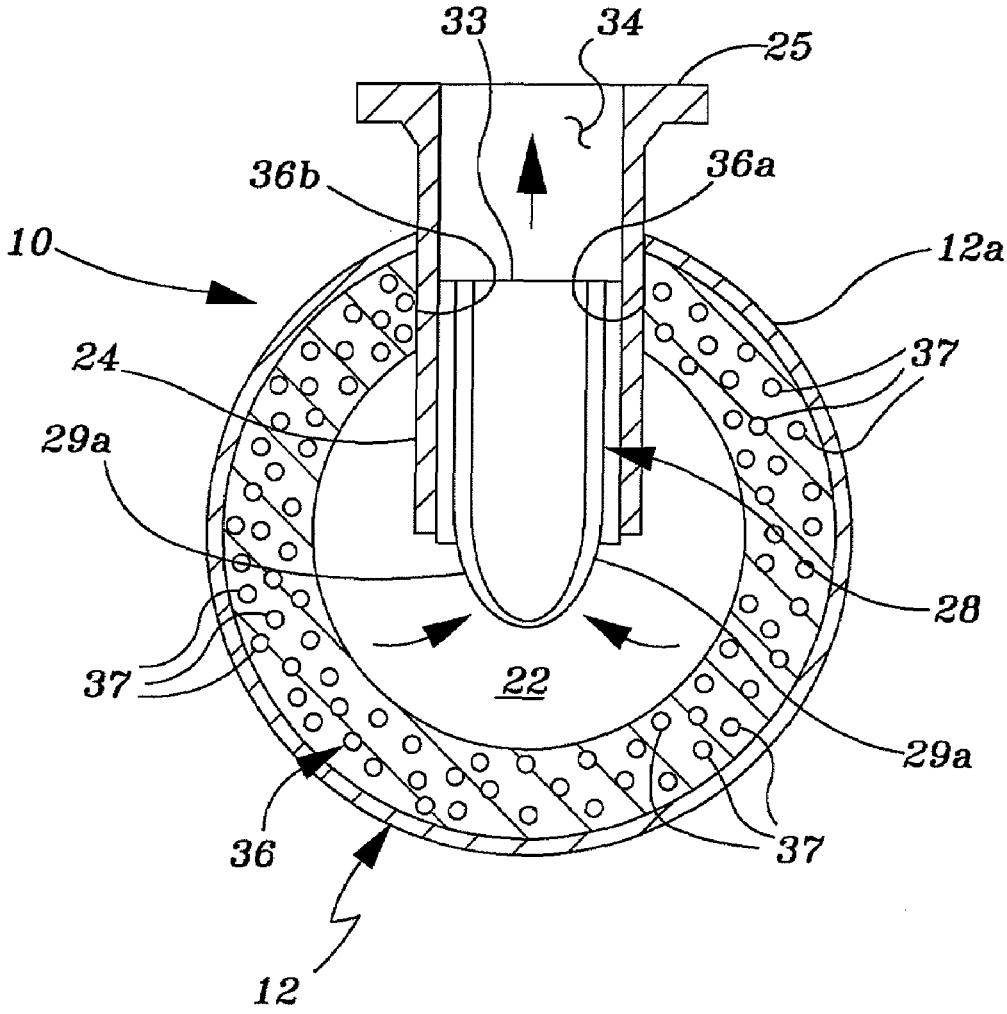
FIG. 5 is a section view of a discharge tube of the inlet manifold of FIG. 1.

The manifold 10 includes three spaced apart fluid guide and mixing tubes 24 which extend normal to a longitudinal axis 26 of the manifold member 12 and are spaced apart such that respective flanges 25 of the guide and mixing tubes 24 may be bolted directly to pump fluid inlet port flanges or to the inlet valve housings 50 of the multi-cylinder plunger or piston pump 40, as shown in FIG. 1. Although three fluid conducting guide and mixing tubes 24 are shown for the manifold 10, those skilled in the art will recognize that a manifold enjoying the benefits of the present invention may include any number of fluid guide and mixing tubes arranged in the manner required for connecting the manifold to a single or multi-cylinder pump, as previously mentioned. The guide and mixing tubes 24 may be suitably secured to the manifold member 12 such as by being integrally cast with the manifold member or by welding at the juncture of the respective tubes with the cylindrical tubular wall 12*a* of the manifold member. As shown in FIGS. 2 and 3, the fluid inlet ends 27 of the tubes 24, opposite the flanges 25, are disposed generally along the axis 26 and extend well within the chamber 22 so that fluid entering the chamber 22 will be drawn into the tubes 24 and solids entrained with the fluid will not tend to settle out within the chamber 22.

Figure 4:
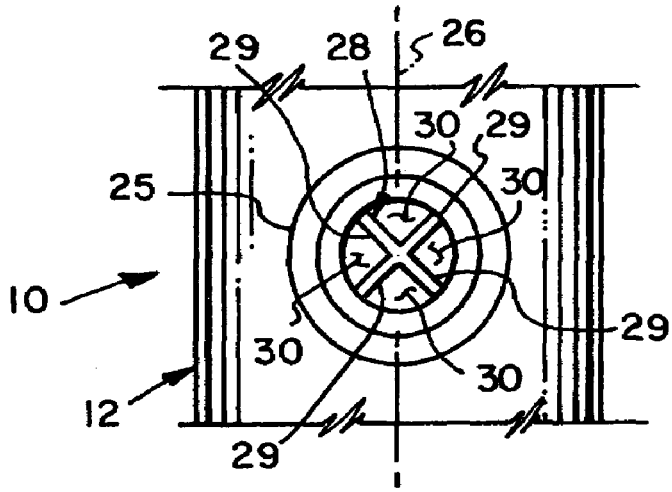
FIG. 4 is a detail plan view taken generally from the line 4-4 of FIG. 3.

Referring further to FIGS. 2 through 4, each of the guide and mixing tubes 24 is provided with a fluid guide partition 28 including relatively thin wall partition members 29 equally circumferentially spaced and radially projecting, as shown, to form flow passages 30, FIG. 4. Partition members 29 are preferably oriented at angles of about 45° to axis 26, as shown, particularly in FIGS. 2, 3 and 4. The partitions 28 may, preferably, extend below the inlet ends 27 of the tubes 24 and have a slightly reduced width of the partition members 29, as illustrated in FIGS. 2 and 3. In fact, the lower end edges of the partition members 29 may be configured to have an arcuate, somewhat elliptical or tapered geometry, as illustrated and designated by the numerals 29*a*. The partitions 28 are suitably secured in the tubes 24 by welding, for example.

The unnumbered arrows illustrated in FIGS. 2 and 3 indicate the general direction of flow of fluid through the manifold 10 and, to some extent, as illustrated by the length of the arrows in FIG. 2, the distribution of fluid volume flow rate. As further shown in FIGS. 2 and 3, the partitions 28 do not extend the full length of the guide and mixing tubes 24, respectively. The partitions 28, which each form four separate flow chambers 30, see FIG. 4, extend from the inlet ends 27 of the tubes 24 approximately 30% to 70% of the length of the tubes 24. Thus, the tubes 24 form a guide tube section between ends 27 and the upper transverse edges 33 of the partitions 28, and the remainder of the tubes 24 between the partitions and the flanges 25 form mixing chamber portions of the tubes 24, which chambers are designated by the numerals 34 in FIGS. 1 and 2.

Referring further to FIGS. 1 and 2, the manifold 10 is advantageously provided with an elongated somewhat cylindrical resilient liner 36 which extends substantially the length of the manifold member 12 between the end caps 14 and 16. The liner 36 is preferably formed of a resilient material, such as cured natural rubber, synthetic rubber or a flexible polymer which has been processed with a nitrogen based chemical foaming agent, such as a type sold under the trade name CELOGEN by Crompton Corporation. Accordingly, the liner 36 is formed with myriad closed cells which are filled with nitrogen, and some of which are designated by the numeral 37 in FIGS. 2 and 3. The liner 36 may be fabricated using known processes for forming rubber and plastic members using a commercially available foaming agent described hereinabove. The liner 36 is, of course, easily replaced if needed by removing one or both of the end caps 14 and 16 and merely sliding the liner into or out of the chamber 22. In this regard, the liner 36 does not form a complete cylindrical tube, but is truncated by opposed edges 36*a* and 36*b*, see FIG. 3, so that the liner may be easily inserted in and removed from the member 12.

As pointed out above, the fluid inlet manifold 12 provides a relatively large volume closed chamber 22 disposed immediately adjacent the valve inlet ports of a reciprocating piston or plunger pump, such as the pump 40. The liner 36 will flex in response to pressure changes and will tend to provide pump inlet liquid volume capacity change as pressures change. The nitrogen filled cells 37 of the liner 36 require essentially no maintenance and maintain their pressure gas charge. The liner 36 undergoes dynamic response to pressure changes within the chamber 22 to stabilize velocities in the chamber 22 and the tubes 24. Moreover, acceleration induced pressure variations from pump inlet valves opening and closing are substantially prevented from propagating within a piping system connected to the manifold 10. The tubes 24 are operable to minimize fluid inlet pressure drops and tend to concentrate solid particulates entrained in the fluid in the centers of the fluid flowstreams by centrifugal forces within each of the tubes 24. As fluid leaves the passages 30 formed by the guides 28, thorough mixing of entrained solids occurs in the passages 34 prior to entering the pump inlet valves.

The manifold 10 may be fabricated using conventional engineering materials and practices, other than those mentioned herein, and known to those skilled in the pump and piping arts. Although a preferred embodiment of the invention has been described in detail, those skilled in the art will also recognize that various substitutions and modifications may be made without departing from the scope and spirit of the inventive concept.

What is claimed is:

1. A fluid inlet manifold for a reciprocating piston/plunger pump, said manifold comprising:

an elongated manifold member having a substantially central axis, a first end closed by a transverse end member, a second end closed by a transverse end member, one of said end members being adapted for connection to a fluid inlet conduit, said manifold member defining a fluid chamber therewithin;

spaced apart transversely extending fluid discharge tubes connected to said manifold member and extending within said chamber, each of said discharge tubes being adapted for connection to a fluid inlet member of said pump;

partitions disposed within respective ones of said tubes and forming plural flow passages within said tubes for discharging fluid and entrained particulates to said pump; and a resilient liner disposed in said chamber and formed of one of natural rubber, synthetic rubber and polymer which includes plural gas filled closed cells within the structure of said liner, said liner being responsive to pressure changes of fluid flowing through said manifold to stabilize velocities of fluid flow in said chamber and said tubes and minimize acceleration induced pressure variations, wherein said liner is delimited by opposed edges defining a slot whereby said liner may be inserted in and removed from said manifold member by removing a member closing at least one end of said manifold member.

2. The manifold set forth in claim 1 wherein:

said tubes extend within said chamber substantially to said central axis of said manifold member.

3. The manifold set forth in claim 1 wherein:

said partitions are formed as relatively thin walled plate members dividing said tubes into said plural flow passages, the orientation of said plate members being at an acute angle with respect to a longitudinal axis of said manifold member.

4. The manifold set forth in claim 1 wherein:

said tubes each include a fluid mixing chamber interposed said partitions and a discharge end of said tubes, respectively.

5. A fluid inlet manifold for a reciprocating piston/plunger pump, said manifold member having a substantially central axis, a first end closed by a transverse end member, a second end closed by a transverse end member, one of said end members being adapted for connection to a fluid inlet conduit, said manifold member defining a fluid chamber therewithin;

spaced apart transversely extending fluid discharge tubes connected to said manifold member and extending within said chamber, each of said discharge tubes being adapted for connection to a fluid inlet member of said pump; and a resilient liner disposed in said chamber and operable to flex in response to pressure changes of fluid flowing through said manifold to substantially prevent collection of solids in said chamber and to reduce the viscosity of shear thinning fluids flowing through said chamber to minimize pressure losses of said shear thinning fluids flowing to and through said pump, said liner is formed of one of natural rubber, synthetic rubber and a polymer which is provided with plural gas filled closed cells within the structure of said liner and has a share conforming to a wall surface of said manifold member delimiting said chamber, and said liner is configured to be inserted in or removed from one end of said manifold member.

6. A fluid inlet manifold for a reciprocating piston/plunger pump, said manifold member comprises a generally cylindrical tube member having a substantially central axis, a first end closed by a transverse end member, a second end closed by a transverse end member, one of said end members being adapted for connection to a fluid inlet conduit, said manifold member defining a fluid chamber therewithin;

spaced apart transversely extending fluid discharge tubes connected to said manifold member and extending within said chamber, each of said discharge tubes being adapted for connection to a fluid inlet member of said pump;

partitions disposed within respective ones of said tubes and forming plural flow passages within said tubes for discharging fluid and entrained particulates to said pump;

a resilient liner having a shape conforming to a wall surface of said manifold member delimiting said chamber and configured to be inserted in or removed from one end of said manifold member, and having plural gas filled closed cells within the structure of said liner, and said liner is delimited by opposed edges defining a slot whereby said liner may be inserted in and removed from said manifold member by removing a member closing at least one end of said manifold member, wherein said liner is disposed in said chamber and operable to flex in response to pressure changes of fluid flowing through said manifold.

7. The manifold set forth in claim 6 wherein:

said partitions extend within said chamber beyond a fluid inlet end of said tubes, respectively.

8. The manifold set forth in claim 7 wherein:

said partitions have an arcuate edge at portions which extend beyond said inlet end of said tubes.

9. The manifold set forth in claim 5 wherein:

said tubes extend within said chamber substantially to said central axis of said manifold member.

10. The manifold set forth in claim 5 wherein:

said tubes are integrally formed with said manifold member.

11. The manifold set forth in claim 5 wherein:

said tubes are formed as separate members and are secured to said manifold member at junctions with a wall of said manifold member, respectively.

12. The manifold set forth in claim 6 wherein:

said liner having said plural gas filled closed cells is formed of one of natural rubber, synthetic rubber and a polymer.

13. The manifold set forth in claim 6 wherein:

said tubes extend within said chamber substantially to said central axis of said manifold member.

14. The manifold set forth in claim 6 wherein:

said tubes are integrally formed with said manifold member.

15. The manifold set forth in claim 6 wherein:

said tubes are formed as separate members and are secured to said manifold member at junctions with a wall of said manifold member, respectively.

16. The manifold set forth in claim 6 wherein:

said partitions are formed as relatively thin walled plate members dividing said tubes into said plural flow passages, the orientation of said plate members being at an acute angle with respect to a longitudinal axis of said manifold member.

17. The manifold set forth in claim 6 wherein:

said tubes include a mixing chamber interposed between said partitions and a fluid discharge end of said tubes, respectively.

* * * * *

UNITED STATES PATENT AND TRADEMARK OFFICE

CERTIFICATE OF CORRECTION

PATENT NO. : 7,621,728 B2
APPLICATION NO. : 11/146695
DATED : November 24, 2009
INVENTOR(S) : J. Davis Miller It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 975 days.

Signed and Sealed this

Fourteenth Day of December, 2010

David J. Kappos

David J. Kappos
*Director of the United States Patent and Trademark Office*